US005842311A

United States Patent [19]

Morin

[11] Patent Number: 5,842,311

[45] Date of Patent: Dec. 1, 1998

[54] GUTTER SCREEN OR COVER

[76] Inventor: Fernand R. Morin, R.R. 2, Mattawa, Ontario, Canada, P0H 1V0

[21] Appl. No.: 774,539

[22] Filed: Dec. 30, 1996

[51] Int. Cl.[6] ..... E04D 13/076

[52] U.S. Cl. ..... 52/12

[58] Field of Search ..... 52/12, 11, 16; 210/474

[56] References Cited

U.S. PATENT DOCUMENTS

| | | | |
|---|---|---|---|
| 2,988,226 | 6/1961 | Campbell | 52/12 |
| 4,941,299 | 7/1990 | Sweers | 52/12 |
| 5,095,666 | 3/1992 | Williams, Jr. | 52/12 |
| 5,271,192 | 12/1993 | Nothum, Sr. et al. | 52/12 |
| 5,406,754 | 4/1995 | Cosby | 52/12 |
| 5,555,680 | 9/1996 | Sweers | 52/12 |
| 5,595,027 | 1/1997 | Vail | 52/12 |
| 5,611,175 | 3/1997 | Sweers | 52/12 |
| 5,640,810 | 6/1997 | Pietersen | 52/12 |

*Primary Examiner*—Michael Safavi

*Attorney, Agent, or Firm*—Allen D. Gutchess, Jr.

[57] ABSTRACT

A gutter screen is provided to be placed over the open top of a gutter to enclose the top to enable water to enter but to keep debris out. The gutter screen has a longitudinally-extending front portion, a longitudinally-extending rear portion, and an intermediate longitudinally-extending portion. A front edge of the front portion has divergent legs to engage a front lip of the gutter to help hold the gutter screen in place. The intermediate portion is perforate over substantially the width thereof from the back portion to the front portion of the gutter and being convex as viewed from above. The back portion preferably has two longitudinally-extending, directly opposite grooves near the intermediate portion. These enable the back portion to be bent upwardly or downwardly to fit a particular installation. The back portion can be bent upwardly or downwardly to engage a fascia behind the gutter. The back portion, from the grooves to the back edge of the back portion, tapers to an edge to facilitate installation under shingles when used with that type of installation. The taper also facilitates downward installation between the rear gutter wall and the fascia.

2 Claims, 2 Drawing Sheets

GUTTER SCREEN OR COVER

This application relates to a screen or cover for a gutter organ eavestrough.

The gutter screen lets water into the gutter but keeps debris such as leaves, tree needles, etc. out, as is known in the art. Previously, gutter screens have tended to be too expensive and may collapse under ice and snow loads. They may also blow away in high winds. Rattling noises also sometimes tend to be a problem.

The gutter screen in accordance with the invention can be injected or extruded or stamped of various plastic materials or metals and is relatively inexpensive. The new gutter screen has three main portions: one is a longitudinally-extending rear portion, another is a longitudinally-extending front portion, and a third is a longitudinally-extending intermediate portion. A front edge of the front portion has means preferably in the form of divergent legs to engage a front lip of the gutter to help hold the gutter screen in place. The intermediate portion of the gutter screen is preferably perforate over substantially the width thereof from the back portion to the front portion. It is also preferably convex between the front portion and the back portion, as viewed from above. In a preferred form, the back portion has two longitudinally-extending, directly opposite grooves near the intermediate portion. The back portion also tapers from the grooves to a thin back edge of the back portion.

The new gutter screen enables the back portion to be bent upwardly along the grooves and screwed to a fascia when the gutter screen is assembled in front. The gutter screen can also enable the back portion to be bent downwardly and placed between the back of the gutter and the fascia. As a third approach, the back portion of the screen can be left straight. It can then be pushed under roof shingles near the edge portion of the roof and then backed up slightly to enable the forward edge of the screen to engage a section of the gutter lip.

It is, therefore, a principal object of the invention to provide a gutter screen which can be applied to a gutter by being fastened to the fascia above the gutter, by being inserted between the back of the gutter and the fascia, or by being slid under shingles near the front edge of the roof.

Other objects and advantages of the invention will be apparent from the following detailed description of a preferred embodiment thereof, reference being made to the accompanying drawings, in which.

Figure 1:
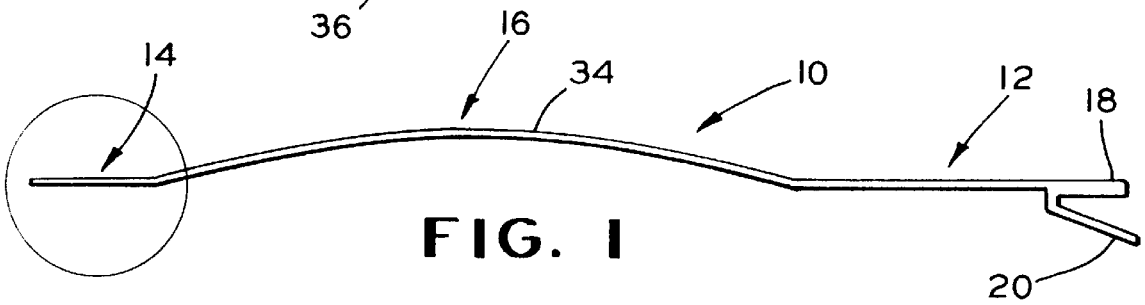
FIG. 1 is a somewhat schematic end view or profile of a gutter screen embodying the invention.

Referring to the drawings and particularly to FIG. 1, a gutter screen embodying the invention is indicated at 10. It is of an optional length to facilitate shipping. The gutter screen 10 includes a front, longitudinally-extending portion 12, a rear, longitudinally-extending portion 14, and an intermediate, longitudinally-extending portion 16.

Figure 2:
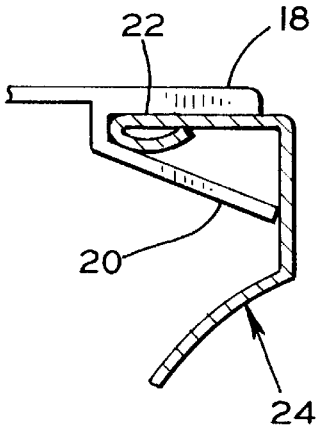
FIG. 2 is an enlarged, fragmentary end view of a front edge portion of the screen and showing an edge of a gutter in section.

Referring to FIG. 2, the front edge portion has divergent legs 18 and 20 designed to engage a front lip 22 of a gutter fragmentarily shown as 24. The lip 22 has a doubled-back portion, as shown, for extra strength and stiffness. The leg 18 preferably is in the plane of the front portion 12 to form a flat surface which minimizes catching debris.

Figure 3:
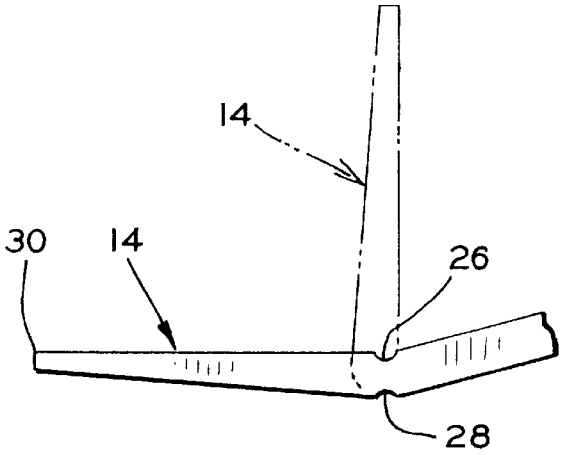
FIG. 3 is an enlarged end view of a rear portion of the gutter screen showing an alternate position in dotted lines for part of the edge portion.

The rear longitudinally-extending portion 14 of the screen 10 is best shown in FIG. 3. The back portion 14 has upper and lower, directly opposite, longitudinally-extending grooves 26 and 28 near the intermediate portion 16. These grooves facilitate bending the back portion 14 up, as shown in dotted lines in FIG. 3, or down, as would be used in FIG. 5. As shown in FIG. 3, the back portion 14 tapers from the grooves 26 and 28 toward a back edge 30.

The intermediate portion 16 extends between the front portion 12 and the rear portion 14 and has openings or perforations 32 substantially over its width. These are of such size as to enable water to enter the gutter but keep out debris. These are formed after the screen blank is extruded or injected or stamped of various plastics or metals. A central portion 34 of the intermediate portion 16 is convex as viewed from above. This adds stiffness and deters collapse of the gutter screen due to ice and snow. It also facilitates the removal of debris by water passing over the gutter in a heavy storm or by high wind.

Figure 4:
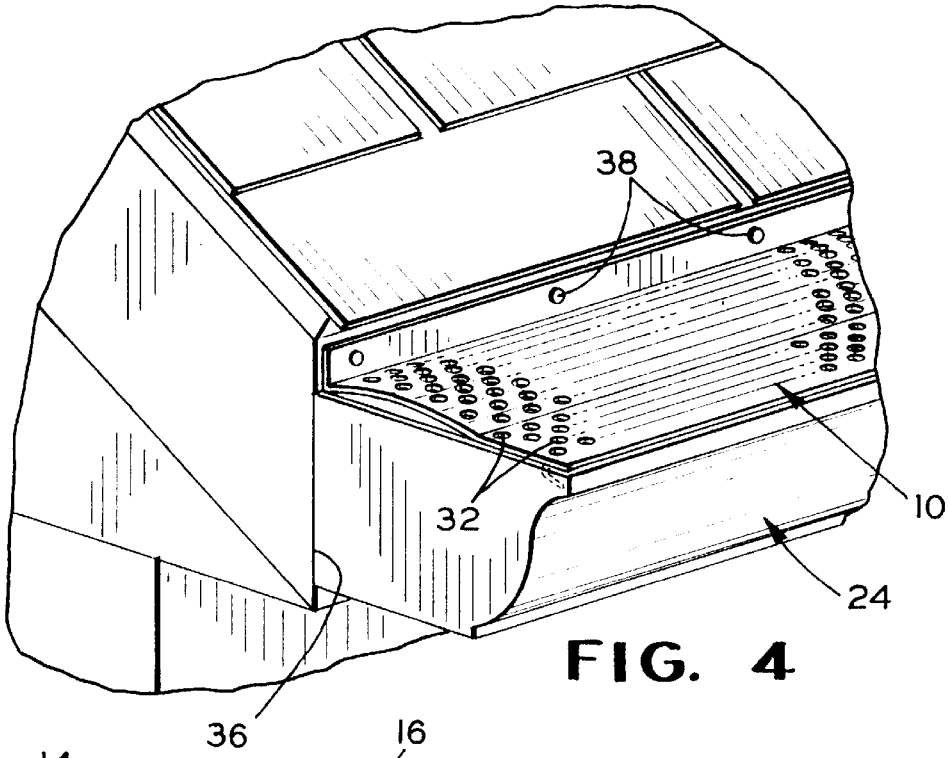
FIG. 4 is a fragmentary view in perspective of a gutter, a gutter screen, and fascia board with the gutter screen installed.

In one form of installation, as shown in FIG. 4, the gutter screen 10 is assembled with the gutter 24 by being pushed downwardly in place to engage the legs 18 and 20 with the front lip 22 of the eavestrough 24. The rear portion 14 is then pushed downwardly to bend the rear portion 14 upwardly beyond the groove 26 so that it stays flat against the fascia 36. The rear portion 14 can then be fastened to the fascia with fasteners 38, such as nails, screws, or staples.

If it is desired to gain access to the interior of the gutter 24, the front portion 12 of the screen can be pushed rearwardly and lifted with the rear portion 14 remaining in place.

Figure 5:
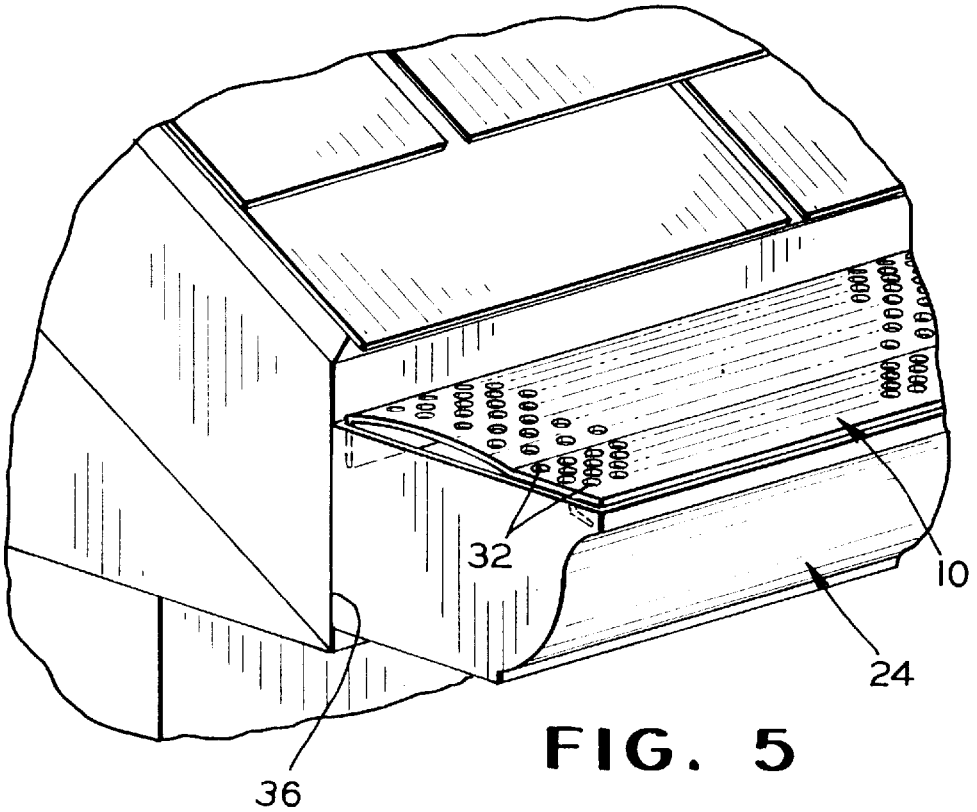
FIG. 5 is a view similar to FIG. 4 but showing the rear portion of the gutter screen installed between the gutter and the fascia.

Referring to FIG. 5, another technique of assembling the screen and gutter is shown. In this instance, the screen 10 is in place relative to the front lip of the eavestrough as before. However, the rear portion 14 of the gutter screen is bent downwardly opposite to the position shown in FIGS. 3 and 4 and is placed between a back wall of the gutter 24 and the fascia 36. The screen can be removed as in FIG. 4.

Figure 6:
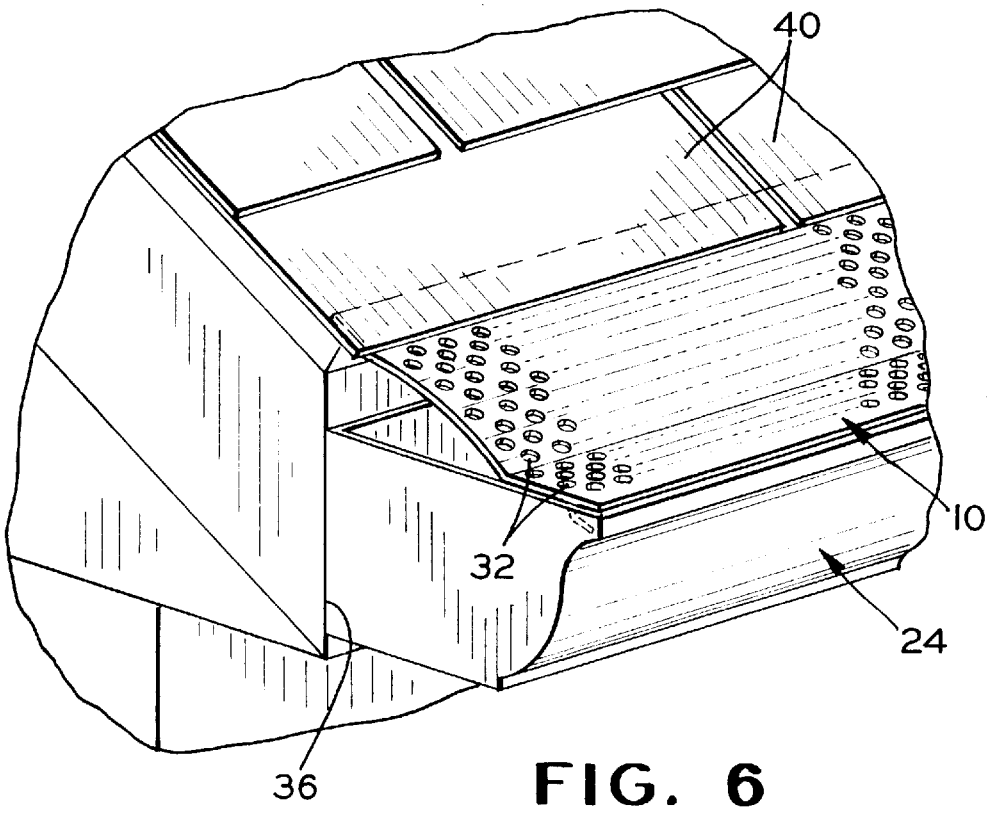
FIG. 6 is another view similar to FIGS. 4 and 5 but showing the gutter screen with the rear portion straight and slid under shingles of a roof.

In the technique shown in FIG. 6, the gutter screen 10 is assembled with the front lip of the gutter as before. However, the rear portion 14 of the screen remains straight and is slid under shingles such as shingles 40 at the front edge portion of the roof. The tapered edge 30 of the rear portion 14 facilitates this assembly.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A gutter screen to be placed over the open top of a gutter to enclose the top to enable water to enter but to keep debris out, the gutter screen being of flexible material and of a predetermined length, said gutter screen having a front, longitudinally-extending front portion, a rear, longitudinally-extending rear portion, and an intermediate longitudinally-extending portion, a front edge of said front portion having divergent legs to engage a front lip of the gutter to help hold the gutter screen in place, said intermediate portion being perforate over substantially the width thereof from the back portion to the front portion and being convex from the front portion to the back portion as viewed from above, said back portion having two longitudinally-extending, directly opposite grooves near said intermediate portion to facilitate bending the back portion beyond said grooves to an upward or downward position to engage a fascia to which the gutter is attached, said back portion tapering from said grooves to a back edge of said back portion.

2. A gutter screen to be placed over the open top of a gutter to enclose the top, the gutter screen being of a flexible material, said gutter screen having a front, longitudinally-extending front portion, a rear, longitudinally-extending rear portion, and an intermediate longitudinally-extending portion, a front edge of said front portion having means to engage a front lip of the gutter to help hold the gutter screen in place, said means to engage a front lip of the gutter on said front edge of said front portion being a pair of divergent legs which encompass the front lip of the gutter on opposite sides thereof, said intermediate portion being perforate over substantially the width thereof from the back portion to the front portion and being convex from the front portion to the back portion as viewed from above, and said back portion having two longitudinally-extending, directly opposite grooves near said intermediate portion to facilitate bending the back portion beyond said grooves to an upward or downward position to help hold said back portion in place.

* * * * *

UNITED STATES PATENT AND TRADEMARK OFFICE

CERTIFICATE OF CORRECTION

PATENT NO. : 5,842,311

DATED : December 1, 1998

INVENTOR(S) : Fernand R. Morin

It is certified that error appears in the above-identified patent and that said Letters Patent is hereby corrected as shown below:

Column 1, line 4, "organ" should be --or an--.

Signed and Sealed this

Twenty-third Day of March, 1999

*Attest:*

Q. TODD DICKINSON

*Attesting Officer*

*Acting Commissioner of Patents and Trademarks*